US008789513B2

(12) United States Patent
McCune et al.

(10) Patent No.: US 8,789,513 B2
(45) Date of Patent: Jul. 29, 2014

(54) FUEL DELIVERY SYSTEM

(75) Inventors: Donald J. McCune, Farmington Hills, MI (US); Harsha Badarinarayan, Canton, MI (US); Pilar Hernandez Mesa, Las Palmas de Gran Canaria (ES); George Saikalis, West Bloomfield, MI (US)

(73) Assignee: Hitachi, Ltd, Tokyo (JP)

( * ) Notice: Subject to any disclaimer, the term of this patent is extended or adjusted under 35 U.S.C. 154(b) by 258 days.

(21) Appl. No.: 13/245,090

(22) Filed: Sep. 26, 2011

(65) Prior Publication Data

US 2013/0074804 A1 Mar. 28, 2013

(51) Int. Cl.
*F02M 69/46* (2006.01)

(52) U.S. Cl.
USPC ..... 123/457; 123/456; 123/511

(58) Field of Classification Search
USPC ..... 123/445, 446, 457, 467, 468, 469, 495, 123/506, 510, 511
See application file for complete search history.

(56) References Cited

U.S. PATENT DOCUMENTS

| | | | | |
|---|---|---|---|---|
| 4,913,089 | A | 4/1990 | Atkins et al. | |
| 5,190,067 | A | 3/1993 | Paradis et al. | |
| 5,230,613 | A * | 7/1993 | Hilsbos et al. | 417/439 |
| 5,433,182 | A * | 7/1995 | Augustin et al. | 123/456 |
| 6,000,380 | A * | 12/1999 | Weisbarth | 123/456 |
| 6,213,096 | B1 | 4/2001 | Kato et al. | |
| 6,360,722 | B1 * | 3/2002 | Onishi | 123/467 |
| 6,505,608 | B2 * | 1/2003 | Hiraku et al. | 123/458 |
| 6,823,844 | B2 * | 11/2004 | Steinbrenner et al. | 123/446 |
| 6,899,084 | B2 * | 5/2005 | Miyashita | 123/446 |
| 7,328,687 | B2 * | 2/2008 | Kojima | 123/431 |
| 7,334,571 | B1 | 2/2008 | Beardmore | |
| 7,406,946 | B1 | 8/2008 | Watanabe et al. | |
| 7,509,943 | B2 * | 3/2009 | Ricco et al. | 123/456 |
| 7,757,662 | B2 * | 7/2010 | Cooke | 123/447 |
| 7,802,562 | B2 * | 9/2010 | Lippa et al. | 123/577 |
| 7,827,962 | B2 * | 11/2010 | Weizenauer et al. | 123/456 |
| 8,307,810 | B2 * | 11/2012 | Haas et al. | 123/497 |
| 8,364,384 | B2 * | 1/2013 | Pursifull | 701/104 |
| 2002/0162536 | A1 | 11/2002 | Steinbrenner et al. | |
| 2006/0027213 | A1 | 2/2006 | Nomura et al. | |

FOREIGN PATENT DOCUMENTS

| | | |
|---|---|---|
| EP | 2110542 A1 | 10/2009 |
| EP | 2333305 A2 | 6/2011 |
| FR | 2895033 A3 | 6/2007 |

(Continued)

OTHER PUBLICATIONS

European Search Report dated Mar. 12, 2014 relating to EP 12185948.2.

*Primary Examiner* — Hai Huynh
(74) *Attorney, Agent, or Firm* — Gifford, Krass, Sprinkle, Anderson & Citkowski, P.C.

(57) ABSTRACT

A fuel delivery system for a direct injection internal combustion engine having two fuel rails and a plurality of fuel injectors attached to and fluidly connected with each fuel rail. A first fuel pump has its output connected with the first fuel rail while a second fuel pump has its output connected with the second fuel rail. A crossover pipe fluidly connects the outlets of both the first and second pumps. Both the first pump and the second pump each have an intake stroke and a pumping stroke. Furthermore, the intake stroke of the first pump coincides with the pumping stroke of the second pump and vice versa.

5 Claims, 7 Drawing Sheets

(56) References Cited

FOREIGN PATENT DOCUMENTS

| | | | | | |
|---|---|---|---|---|---|
| JP | H1144276 | A | | 2/1999 | |
| JP | H11270426 | A | | 10/1999 | |
| JP | 2001193599 | A | | 7/2001 | |
| JP | 2007120356 | A | | 5/2007 | |
| JP | 2013-72433 | | * | 4/2013 | ..... F02M 55/02 |
| WO | 0186139 | A1 | | 11/2001 | |
| WO | 2012027310 | A1 | | 3/2012 | |

* cited by examiner

FUEL DELIVERY SYSTEM

BACKGROUND OF THE INVENTION

I. Field of the Invention

The present invention relates generally to fuel delivery systems and, more particularly, fuel delivery systems for a direct injection internal combustion engine.

II. Description of Related Art

In a direct injection internal combustion engine of the type used in automotive vehicles, at least one fuel injector is associated with each combustion chamber in the engine. Furthermore, the fuel injectors are mounted such that the fuel injector injects fuel directly into the combustion chamber rather than upstream from the intake valves as in the previously known multipoint fuel injectors. This direct injection of the fuel into the combustion chamber results in increased engine performance and enhanced fuel economy.

In a conventional direct injection engine, a fuel pump provides pressurized fuel to a fuel rail. Two or more fuel injectors are fluidly connected with the fuel rail. Furthermore, when the engine has cylinders mounted in banks, conventionally a separate fuel rail is provided for each bank of engine combustion chambers.

One of the main advantages of a direct injection fuel delivery system is that it offers better atomization and thereby complete combustion of the fuel since it is injected directly into the combustion chamber at a high pressure. These pressures are on a magnitude of 10-20 times the pressurization required for fuel rails in the previously known multipoint fuel delivery systems.

In order to provide the high pressure fuel to the fuel rail or fuel rails, it has been the previous practice to pressurize the fuel rails with a piston pump that is reciprocally driven by a cam which, in turn, is rotatably driven by the engine. One disadvantage of these previously known piston pumps, however, is that they produce pressure pulsations within the fuel delivery system. In addition, the opening and closing of the injector nozzle (during fuel delivery into the combustion chamber) also result in pressure pulsation. These pressure pulsations result in excessive noise from the fuel delivery system. This noise is particularly noticeable to occupants of the vehicle at low engine speeds.

A still further disadvantage of the previously known direct injection internal combustion engines is that it has oftentimes been necessary to provide two fuel injectors for each combustion chamber. One fuel injector is used during low engine speed when a relatively low amount of fuel is required. Conversely, the second injector is designed to inject larger quantities of fuel into its associated internal combustion chamber at higher engine speeds. Both injectors are controlled by the engine control unit for the vehicle. Typically, pulse width modulation (PWM) is used to activate the proper fuel injector valve between an open and a closed position.

The requirement for two separate fuel injectors disadvantageously increases the overall cost of the fuel injection system.

SUMMARY OF THE PRESENT INVENTION

The present invention provides a fuel delivery system which overcomes the above mentioned disadvantages of the previously known systems.

In one embodiment of the present invention, a first and second fuel rail are provided with each fuel rail associated with one bank of engine combustion chambers. Each fuel rail includes an elongated passageway which is fluidly connected to a plurality of fuel injectors for each fuel rail.

A first fuel pump having a first pumping cycle has an inlet connected to a fuel source, such as the fuel tank, and an outlet fluidly connected to the fuel passageway in the first fuel rail. Similarly, a single fuel pump having a second pumping cycle is provided in which the inlet of the second fuel pump is fluidly connected to the fuel source while the outlet from the second fuel pump is fluidly connected to the fuel passageway in the second fuel rail.

A crossover pipe fluidly connects the outlets of the first and second pumps together. Furthermore, a pressure relief valve is preferably provided between a midpoint of the crossover pipe and the inlet for at least one and preferably both of the fuel pumps.

Each pumping cycle of the first and second pumps has an intake stroke and a pumping stroke. The intake stroke of the first pump coincides with the pumping stroke of the second pump and vice versa. In doing so, pressure pulsations, together with the resultant noise, in the fuel delivery system are reduced.

Noise from the fuel system caused by pressure pulsations is alternatively reduced by providing a plurality of fluid reservoirs so that one fluid reservoir is associated with each of the fuel injectors. The fluid reservoir may be positioned either fluidly in series between the fuel rail and each fuel injector. Alternatively, a fluid reservoir is open to the fuel passageway in the fuel rail at a position aligned with its associated fuel injector, but on the side of the fuel rail opposite from the fuel injector.

A fuel reservoir may also be provided in series in the associated fuel rail.

An improved fuel injector is also provided having an elongated body with an inlet end and an outlet end. A fluid passageway extends between and interconnects the inlet end with its outlet end.

A valve seat is disposed across the outlet end of the body. The valve seat has both a first and second set of fluid passageways wherein each set includes at least one fluid passageway.

A first valve provides fuel for high speed operation and is movably mounted between an open and a closed position in the body. In its closed position, the first valve engages the valve seat and closes the first set of passages. Conversely, in the open position the first valve separates from the valve seat and opens the first set of passages so that fuel flows from the inlet end and to the outlet end of the body and out through the first set of passages.

A second valve provides fuel at low engine speed and is also movably mounted in the body and preferably movably mounted within the first valve between an open and a closed position. In the closed position, the second valve engages the valve seat and closes the second set of orifices. Conversely, in its open position, the second valve separates from the valve seat and opens the second set of orifices to allow fuel flow from the inlet, through the body passageway, and out through the second set of orifices.

An actuator, such as an electromagnet, is contained within the body and selectively energized in a pulse width modulation mode by the engine control unit. Upon the application of a first current, the electromagnet moves the first valve against the force of a compression spring to move the valve from its closed and to its open position. Conversely, the application of a second current value to the electromagnet opens only the second valve while leaving the first valve in a closed position. The second current value is less than the first current value.

BRIEF DESCRIPTION OF THE DRAWING

A better understanding of the present invention will be had upon reference to the following detailed description when read in conjunction with the accompanying drawing, wherein like reference characters refer to like elements throughout the several views, and in which.

DETAILED DESCRIPTION OF PREFERRED EMBODIMENTS OF THE PRESENT INVENTION

Figure 1:
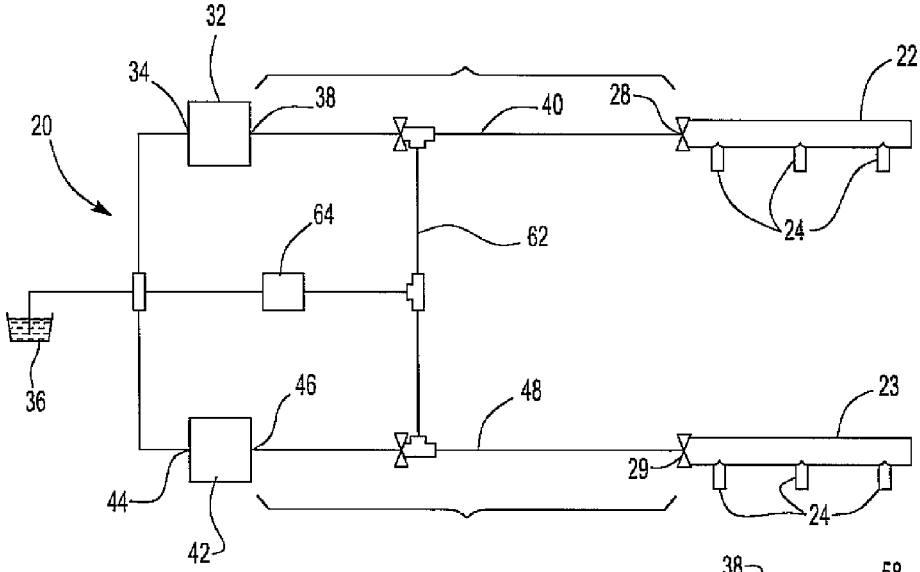
FIG. 1 is a block diagrammatic view illustrating a fuel system of the present invention.
Figure 2:
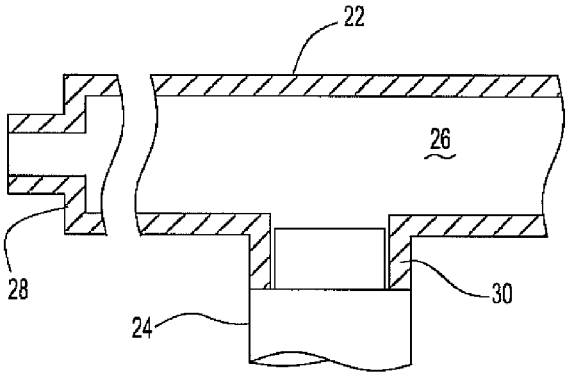
FIG. 2 is a fragmentary longitudinal sectional view illustrating a portion of the fuel system of the present invention.

With reference first to FIGS. 1 and 2, a diagrammatic view of a fuel system 20 in accordance with the present invention is shown. The fuel system includes a pair of spaced apart fuel rails 22 and 23 and at least two fuel injectors 24 associated with each rail.

As best shown in FIG. 2, each fuel rail 22 and 23 includes an elongated fuel passageway 26 having an inlet end 28. A fuel cup 30 is provided for each fuel injector 24. This fuel cup 30 is open to the fuel passageway 26 and its associated fuel rail 22 or 23 to thereby provide fuel to the fuel injector 24.

Referring now primarily to FIG. 1, a first fuel pump 32 has an inlet 34 to a fuel source 36, such as the fuel tank. An outlet 38 from the fuel pump 32 is fluidly connected by a fuel supply line 40 to the inlet end 28 of the first fuel rail 22.

Similarly, a second high pressure pump 42 has its inlet 44 fluidly connected to the fuel source 36 and an outlet 46 fluidly connected by a fuel line 48 to the inlet end 29 of the second fuel rail 23.

Figure 3:
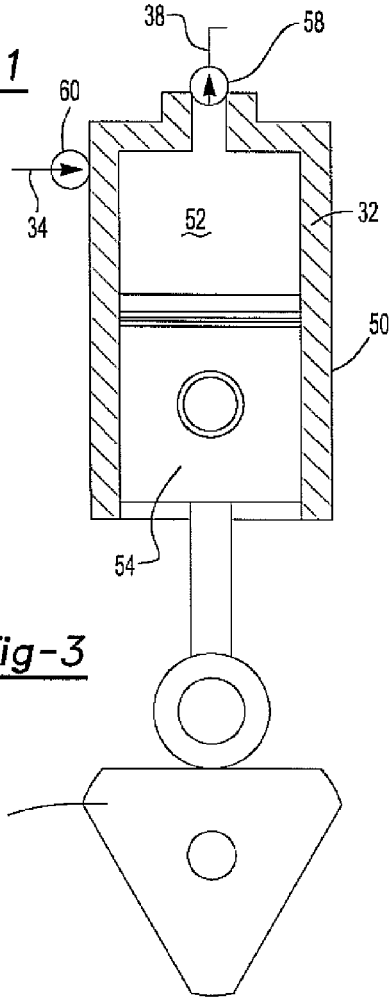
FIG. 3 is a diagrammatic view of a fuel pump of the system of the present invention.

With reference now to FIG. 3, both of the high pressure fuel pumps 32 and 42 are substantially identical to each other in construction. As such, only the fuel pump 32 will be described, it being understood that a like description shall also apply to the second fuel pump 42.

In the simplified diagram of FIG. 3, the fuel pump 32 includes a housing 50 having a pump chamber 52. A piston 54 is reciprocally mounted within the pump chamber 52 and is reciprocally driven by a cam 56 driven by the engine.

A one-way valve 58 is fluidly connected in series between the pump chamber 52 and the outlet 38. Consequently, during the pump stroke of the pump cycle, the piston 54 moves upwardly as viewed in FIG. 3 thus forcing fuel out through the one-way valve 58, through the pump outlet 38, and to the first fuel rail 22.

A one-way valve 60 is connected in series with the inlet 34 for the pump 32. The valve 60 thus allows fuel flow only through the inlet and into the pump chamber 52. Consequently, during an intake stroke, i.e. when the piston 54 moves downwardly within the pump chamber 52, the piston 54 inducts fuel through the one-way valve 60 and into the pump chamber 52. Each pump cycle, furthermore, consists of a single pump stroke and intake stroke.

As mentioned above, the second fuel pump 42 is substantially identical to the first fuel pump 32. However, the cam associated with the second fuel pump 42 is angularly displaced relative to the cam 56 so that the intake stroke of the first pump 32 coincides with the pump stroke of the second pump 42 and, likewise, the pump stroke of the first pump 32 coincides with the intake stroke of the second pump 42.

The pressure pulsations in the overall fuel delivery system 20 caused by using the two pumps shown in FIG. 1 with the pump stroke of one fuel pump coinciding with the intake stroke of the other pump, and vice versa, are greatly reduced as contrasted with the previously known use of a single fuel pump to pressurize both fuel rails 22 and 23. However, in order to further reduce the pressure pulsations in the fuel system and with reference to FIG. 1, a crossover pipe 62 fluidly connects the outlets 38 and 46 of the pumps 32 and 42, respectively. This crossover pipe 62 thus effectively dampens the pressure pulsations since the pressure pulsations pass in part from one of the pumps 32 or 42 during the pump cycle through the crossover pipe 62 and to the other pump during its intake cycle. A pressure relief valve 64 is also fluidly connected between a midpoint of the crossover pipe 62 and at least one, and preferably both inlets 34 and 44 of the pumps 32 and 42, respectively. This pressure relief valve 64 prevents build up of excess pressure in the fuel system.

Figure 4:
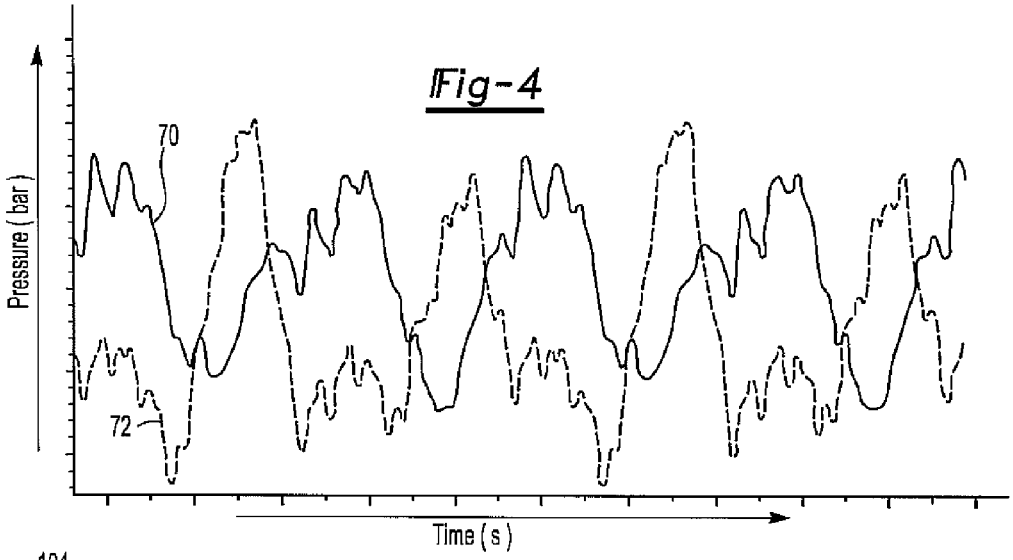
FIG. 4 is a graph illustrating the effect of the crossover pipe and out of phase fuel pumps versus a baseline model.

With reference now to FIG. 4, the net effect of utilizing both the crossover pipe 62 as well as the out of phase fuel pumps 32 and 42 is shown in graph 70 versus the same configuration for a simple model without the crossover pipe and in phase fuel pumps 32 and 42 as shown in graph 72 (this is referred to as the baseline mode). As can be easily seen from FIG. 4, the peaks to the valleys pressure difference of the graph 70, i.e. the crossover pipe 62 and out of phase fuel pumps 32 and 42, is much less than the peak to valley pressure difference of the baseline model without the crossover pipe 62 and with the fuel pumps 32 and 42 in phase. Mathematically, pressure pulsation is defined as the magnitude difference between the peak and valley pressure values. It is desired to minimize this magnitude.

Figure 5:
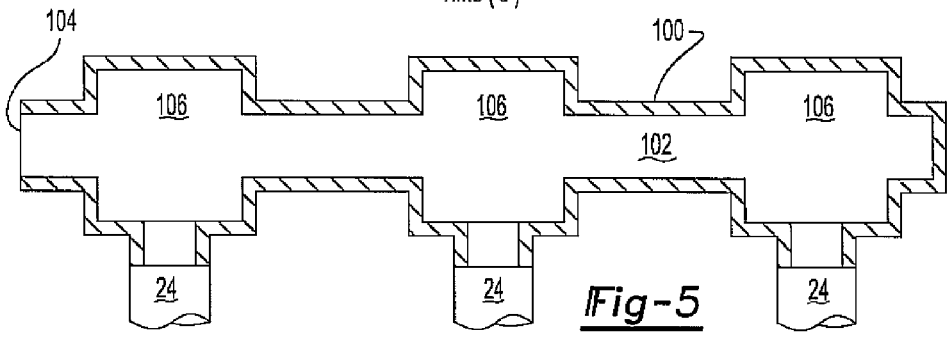
FIG. 5 is a longitudinal sectional view illustrating one preferred embodiment of a fuel rail of the present invention.

With reference now to FIG. 5, a still further aspect of a preferred embodiment of the fuel system of the present invention is shown and includes a second embodiment of a fuel rail 100. As before, the fuel rail 100 includes an elongated fuel passageway which is fluidly connected at an inlet end 104 to the outlet of a fuel pump. At least two, and more typically three or four, fuel injectors 24 are mounted to the fuel rail 100 at longitudinally spaced intervals along the fuel rail 100. Each fuel injector 24 is fluidly open to the fuel rail passageway 102.

Unlike the previously described fuel rail 22 or 23, however, a fuel reservoir 106 is associated with each fuel injector 24. Each fuel reservoir 106 has a cross-sectional area, i.e. as viewed along the length of the fuel rail 100, greater than the cross-sectional area of the fuel passageway 102. Each reservoir 106 also is preferably annular in shape and extends around substantially the entire fuel rail 100. As such, the reservoir 106 is fluidly positioned in part in series between the fuel passageway 102 and the fuel injectors 24 and in part on the side of the fuel rail 100 opposite from the fuel injector 24.

In practice, the reservoirs 106 serve to dampen pressure pulsations from the fuel injector. In doing so, the reservoirs 106 reduce the noise of the fuel delivery system, especially at low engine speeds.

Figure 6:
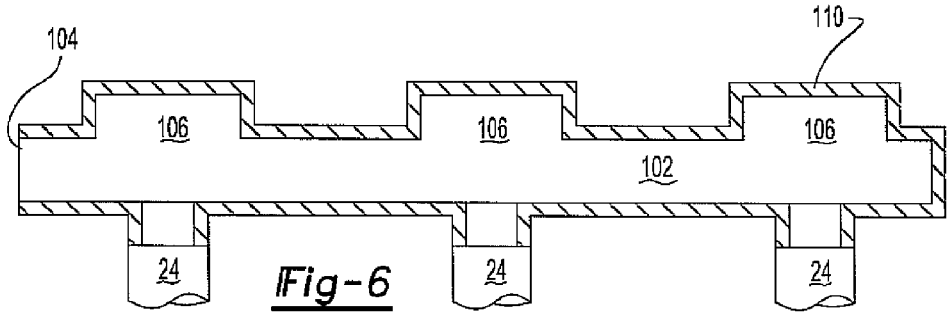
FIG. 6 is a view similar to FIG. 5, but illustrating another preferred embodiment of the fuel rail.

With reference now to FIG. 6, a still further preferred embodiment of a fuel rail 110 is shown. In the fuel rail 110, a reservoir 106 having a greater cross-sectional area than the rail fuel passageway 102 is also shown. However, the fuel rail 110 differs from the fuel rail 100 (FIG. 5) in that the fuel reservoir 106 extends outwardly from the fuel passageway 102 on the side of the fuel rail 110 opposite from its associated fuel injector 24.

Figure 7:
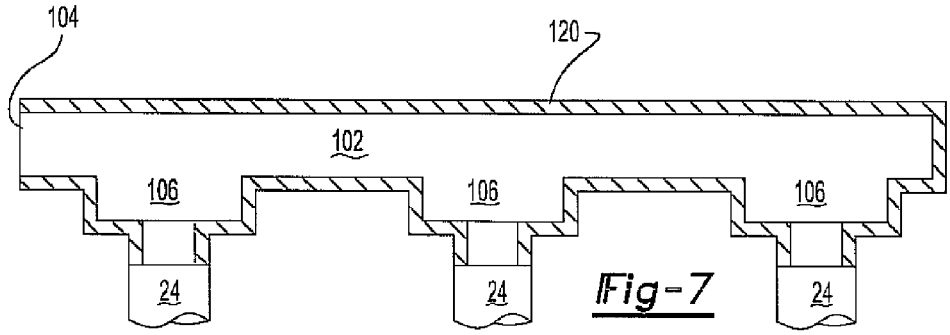
FIG. 7 is a view similar to both FIGS. 5 and 6 and illustrating yet another preferred embodiment of the fuel rail.

With reference now to FIG. 7, a still further preferred embodiment of a fuel rail 120 is shown. As before, a reservoir 106 is associated with each fuel injector 24. Each reservoir 106 has a cross-sectional area as viewed longitudinally along the fuel rail larger than the fuel rail passageway 102. However, unlike the fuel rails 100 and 110 of FIGS. 5 and 6, the reservoirs 106 are fluidly positioned in series between the fuel passageway for the fuel rail 120 and its associated fuel injector 24.

The dimensions and volume of the reservoirs in FIGS. 5-7 will vary depending on many factors including, for example, engine performance requirements. However, as an example only and assuming that the diameter of the rail passageway 102 is D and the spacing of the fuel injectors is in the range of 6-9 D, the longitudinal length of each reservoir is in the range of 2.5-4 D. Typically, the length of the fuel connector from the pump to the fuel rail is in the range of 30-40 D and its diameter is in the range of 0.25-0.5 D.

Figure 8:
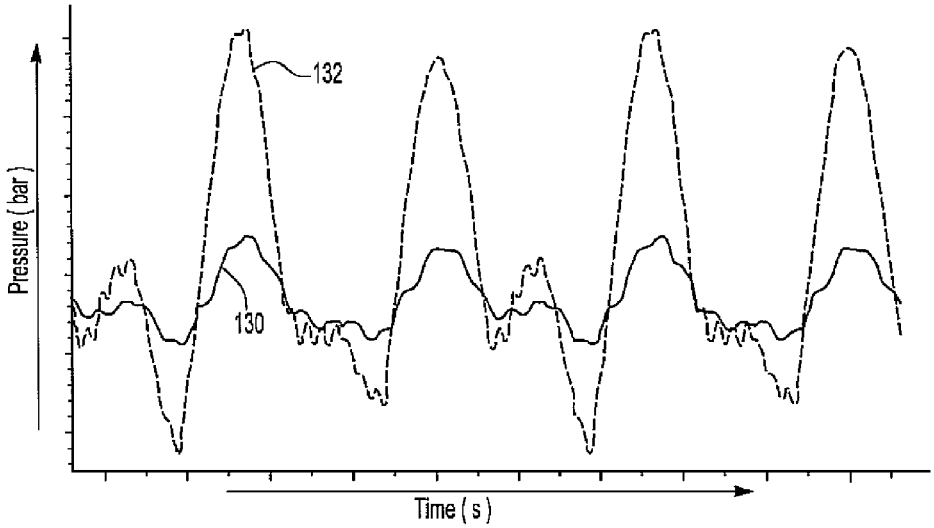
FIG. 8 is a graph illustrating the effects of the fuel rail of FIG. 5.

In practice, the reservoir 106 effectively dampens fuel pressure pulsations that otherwise occur in the fuel rail 100. This is particularly true for low engine speeds. For example, the pressure profile corresponding to FIG. 5 is shown in FIG. 8. Specifically, graph 130 depicts the pressure where the reservoir 106 is contained in the fuel rail as shown in FIG. 5 versus a baseline illustrated in graph 132 in which the reservoir is eliminated.

Figure 9:
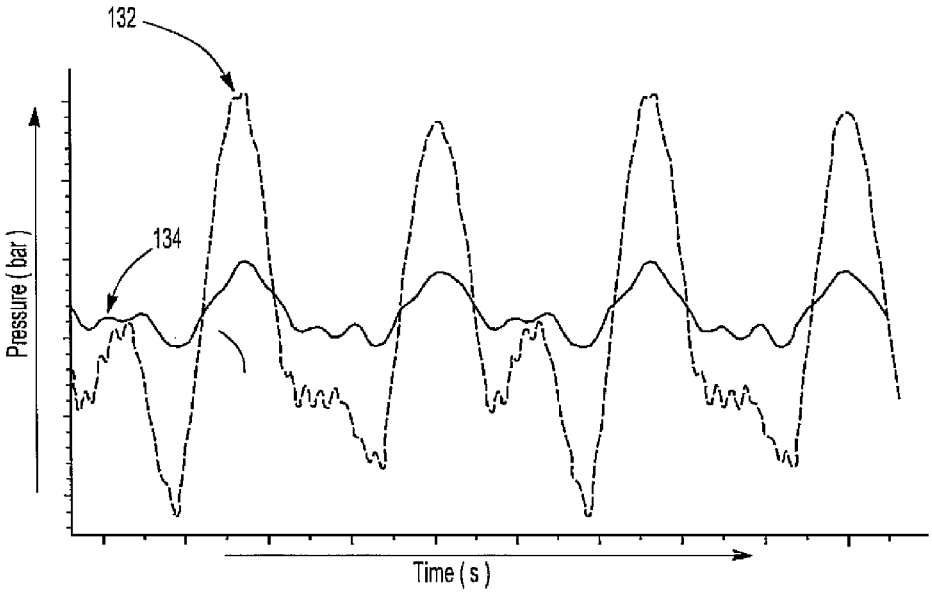
FIG. 9 is a graph illustrating the effects of the fuel rail of FIG. 6.

Similarly, FIG. 9 depicts graph 134 which corresponds with the fuel rail 110 in FIG. 6. As is clear from FIG. 9, the peak to valley differences of the graph 134 are substantially less than the baseline 132 in which the reservoirs 106 are eliminated.

Figure 10:
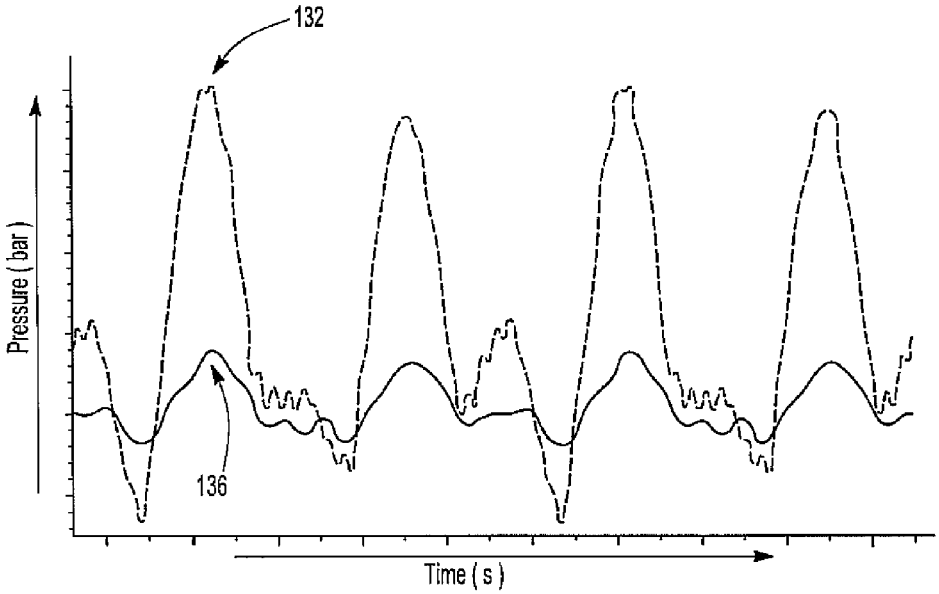
FIG. 10 is a graph illustrating the effects of the fuel rail of FIG. 7.

Similarly, FIG. 10 shows graph 136 which corresponds to the fuel rail 120 shown in FIG. 7. Again, the peak to valley differences of the graph 136 are significantly less than the peak to valley differences of the baseline graph 132.

Figure 11:
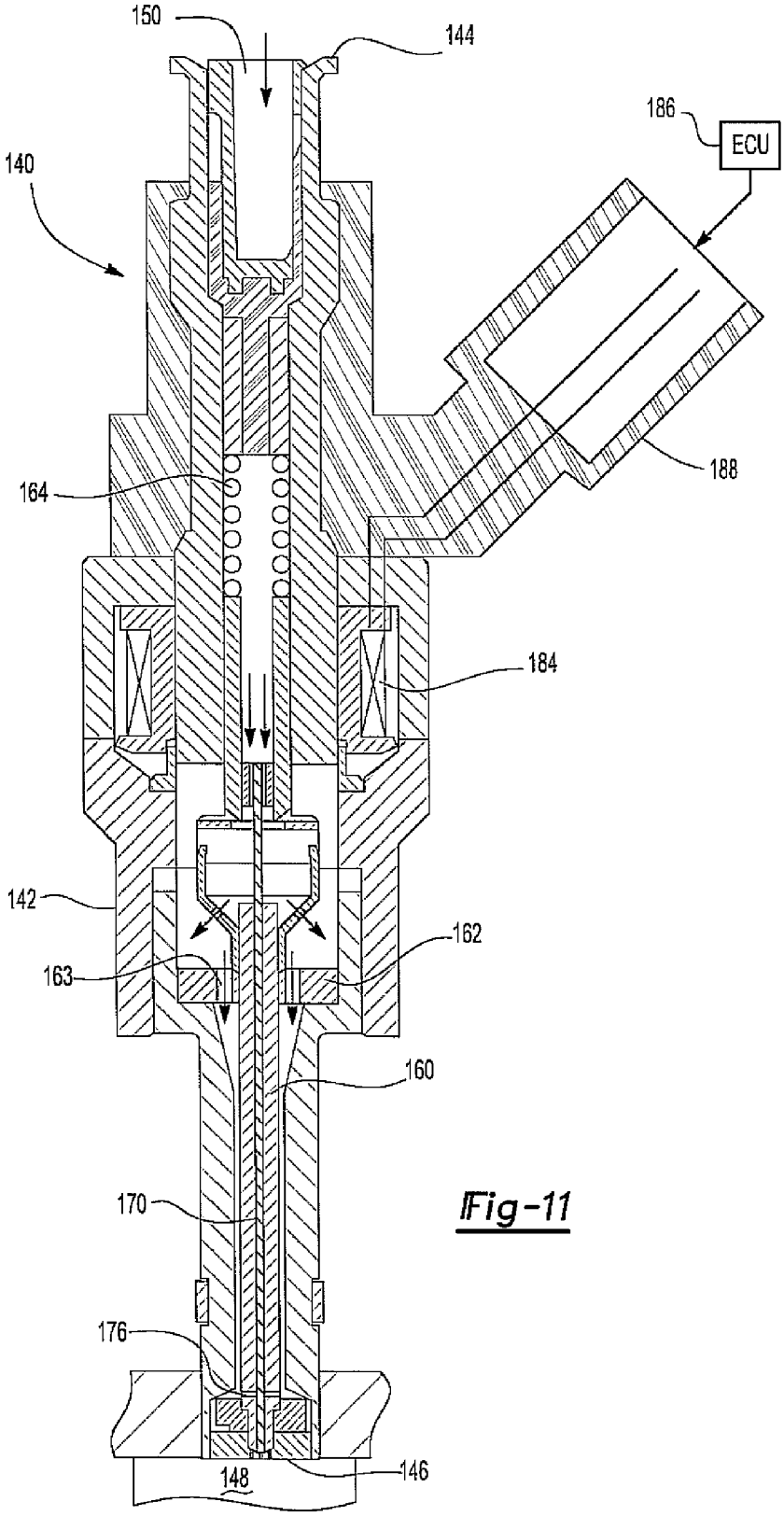
FIG. 11 is a longitudinal sectional view illustrating a preferred embodiment of a fuel injector with both valves in the closed position.
Figures 12, 13:
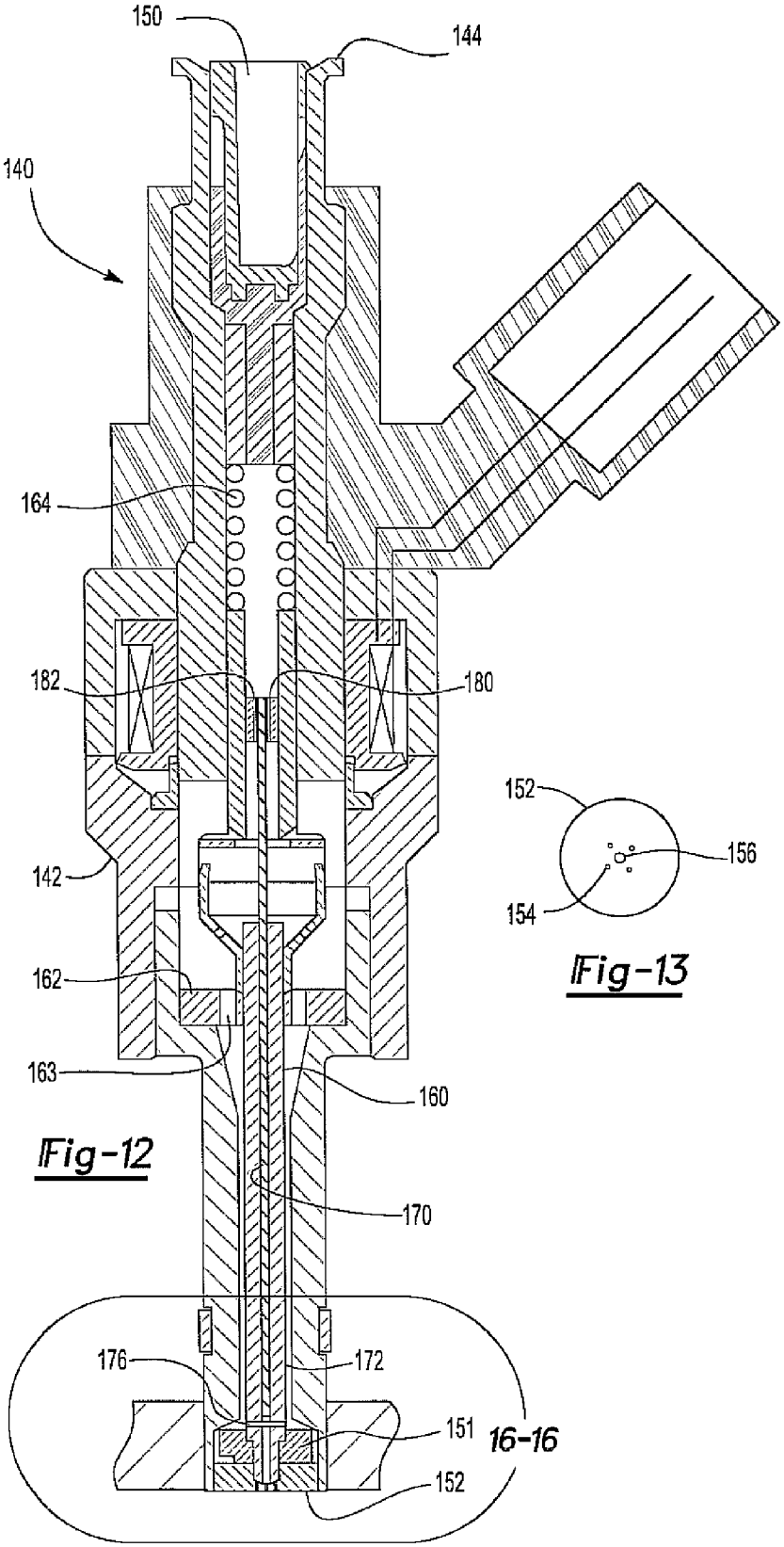
FIG. 12 is a longitudinal sectional view of the fuel injector but with the second valve in an open position.
FIG. 13 is an end view illustrating the valve seat.

With reference now to FIGS. 11 and 12, an improved fuel injector 140 which effectively provides fuel to the direct injection engine at both low and high engine speeds is illustrated. The fuel injector 140 includes an elongated body 142 having an inlet end 144 and an outlet end 146. As in all direct injection engines, the outlet 146 is open to a combustion chamber 148.

A longitudinally or axially extending fuel passageway 150 fluidly connects the inlet end 144 to the outlet end 146 of the body 142. The outlet end 146 of the body 142, furthermore, is covered by a valve seat 152 best shown in FIGS. 12 and 13.

Although the valve seat 152 extends across and closes the outlet end 146 of the body 142, two sets of orifices are provided through the valve seat 152 to allow fuel to pass from the fuel passageway 150 out through the valve seat 152. As best shown in FIG. 13, these orifices are arranged in two sets. The first set 154 includes a plurality of preferably annularly spaced through orifices in the valve seat 152. Conversely, the second set 156 of orifices preferably includes a single through orifice in the center of the valve seat 152.

Figure 14:
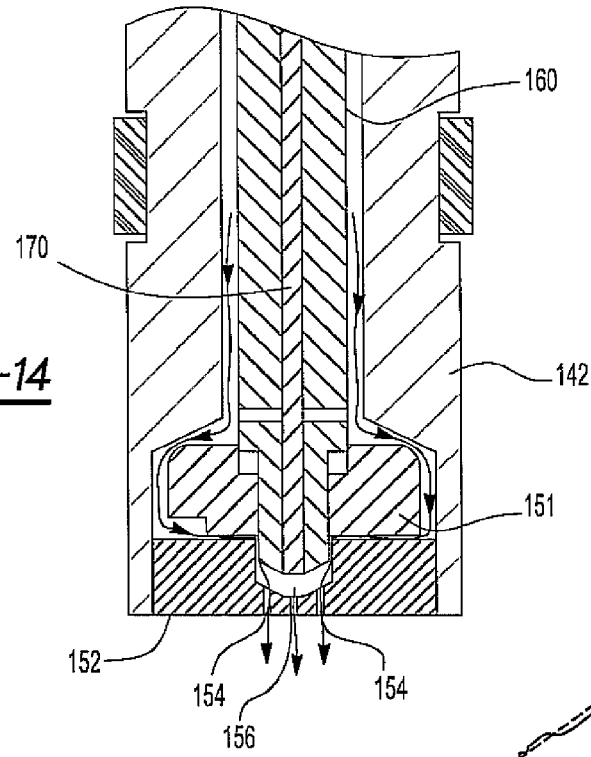
FIG. 14 is a fragmentary sectional view illustrating the first valve in an open position.

Referring again to FIGS. 11 and 12, an elongated first valve 160 which controls fuel delivery during high engine speeds is longitudinally slidably mounted in said body 142 and movable between a closed position, illustrated in FIG. 11, and an open position, illustrated in FIG. 14. In its closed position, the first valve 160 engages the valve seat 152 and closes the first set 154 and second set 156 of through orifices. Conversely, in its open position (FIG. 14) the first valve 160 is retracted from the valve seat 152 thus exposing the first set 154 and second set 156 of through orifices in the valve seat 152 and allowing fuel to flow from the passageway 150 through a mixing plate 151 and out through the first set 154 and second set 156 of through orifices.

A valve guide 162 within the body 142 guides the movement of the first valve 160 between its open and closed positions. Openings 163 through the valve guide 162 establish the fluid communication through the fluid passageway 150. In addition, a spring 164 (FIG. 11) engages the first valve 160 and urges the first valve towards its closed position.

With reference now to FIGS. 11 and 12, an elongated second valve 170 which controls fuel delivery during low engine speeds is longitudinally slidably mounted within a longitudinal throughbore 172 of the first valve 170 so that the second valve 170 is movable relative not only to the first valve 160 but also relative to the body 142.

The second valve 170 is movable between a closed position, illustrated in FIG. 11, and an open position, illustrated in FIG. 12. In its closed position, the second valve 170 engages the valve seat 152 and closes the second set 156 of through orifices, i.e. the central orifice in the valve seat 152. Conversely, when the second valve 170 moves to its open position, fluid flow from the portion of the fluid passageway 150 surrounding the first valve 160 is established through radial ports 176 formed in the first valve 160. These radial ports 176 fluidly communicate fuel from the fuel passageway 150 around the first valve 160 and to a through hole 172 formed axially through the first valve 160 and through which the second valve 170 extends. That fuel then flows outwardly through the second set 156 of orifices in the valve seat 152, i.e. the central orifice. Conversely, when the second valve 170 is in its closed position, the second valve 170 engages and closes the second set of orifices in the valve seat 152.

The second valve 170 is normally urged towards its closed position thus closing the second set 156 of orifices in the valve seat 152. Although any conventional mechanism may be used to urge the second valve 170 towards its closed position, in the preferred embodiment of the invention, an enlarged diameter plunger 180 (FIG. 12) is provided at one end of the second valve 170. This plunger 180 is positioned within the fuel passageway 150 and includes axially extending through bores 182 which form a part of the fuel passageway 150. Consequently, the fuel flow through the fuel passageway 150 coacts with the plunger 180 urging the plunger 180 with its attached second valve 170 towards its closed position.

Alternatively, a spring may be used to urge the second valve 170 to its closed position.

With reference now to FIG. 11, an electromagnet 184 is utilized to actuate the first and second valves 160 and 170, respectively, between their open and closed positions. The electromagnet 184 is disposed adjacent to one end of both the first valve 160 and the second valve 170. Consequently, upon energization of the electromagnet 184 by an engine control unit 186 through an electrical connector 188, the electromagnet 184 exerts a force on the first valve 160 and second valve 170 in an upward (as viewed in FIG. 11) or opening direction.

Energization of the electromagnet 184 with a relatively low current using pulse width modulation (PWM) to control the amount of opening time of a fuel injector will only be sufficient to move the second valve 170 against the force of the fuel flow from its closed to its open position thus allowing fuel flow out through the second set 156 of orifices in the valve seat 152. However, such low current will not be sufficient to overcome the force of the spring 164 so that the first valve 160 remains in a closed position.

Since only a single orifice 156 in the valve seat 152 is open during a low current condition of the electromagnet 184, the amount of fuel delivered to the engine may be accurately controlled even for very small amounts of fuel by using PWM.

Conversely, during a higher engine speed, a higher current is provided to the electromagnet 184, again using PWM to control the on/off time for the fuel injector. This high current, however, is sufficient to move the first valve 160 against the force of the spring 164 thus uncovering the first set 154 of multiple through orifices in the valve seat 146 thus allowing for increased fuel flow through the valve seat and thus increased fuel flow to the engine combustion chamber. During such high fuel flows, the first valve 160 also preferably moves the second valve 170 to its open position against the force of the incoming fuel flow. As such, both the first set 154 as well as second set 156 of orifices will be open.

Figure 15:
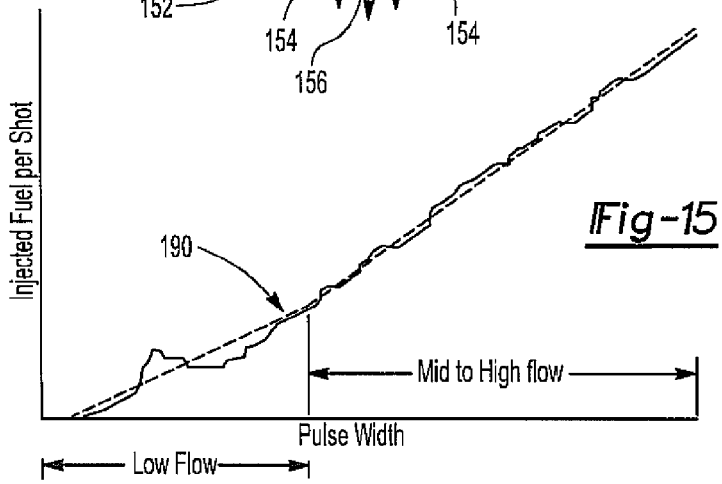
FIG. 15 is a graph illustrating the operation of the fuel injector of FIGS. 11 and 12.
Figure 16:
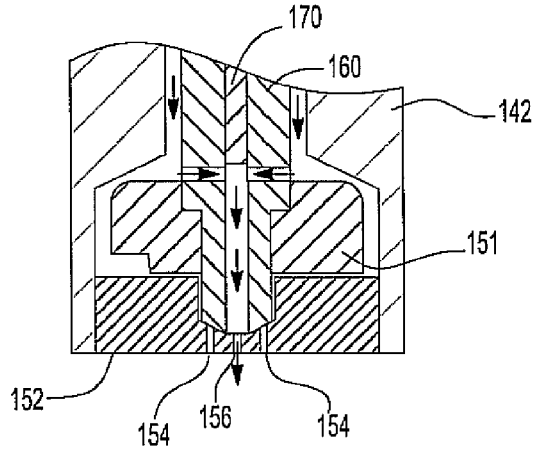
FIG. 16 is an enlarged view of circle 16-16 in FIG. 12.

FIG. 15 illustrates at graph 190 the fuel flow as a function of pulse width in low, mid, and high flow conditions. As can be seen, graph 190 shows a virtually linear response of the fuel flow as a function of pulse width for all engine conditions.

From the foregoing, it can be seen that the present invention provides not only an improved fuel delivery system for a direct injection engine, but also an improved fuel injector that can be used for such engines.

Having described our invention, however, many modifications thereto will become apparent to those skilled in the art to which it pertains without deviation from the spirit of the invention as defined by the scope of the appended claims.

We claim:

1. A fuel delivery system comprising:

a first and second fuel rails, each fuel rail having a fuel passageway, a plurality of fuel injectors, at least two of said fuel injectors fluidly connected to the fuel passageway of each fuel rail, a first fuel pump having a first pumping cycle, said first fuel pump having an inlet connected to a fuel source and an outlet fluidly connected to said fuel passageway of said first fuel rail, a second fuel pump having a second pumping cycle, said second fuel pump having an inlet connected to a fuel source and an outlet fluidly connected to said fuel passageway of said second fuel rail, a crossover pipe fluidly connecting the outlets of said first and second fuel pumps, wherein each of said first and second pumping cycles has an intake stroke and a pumping stroke, and wherein said intake stroke of said first pump coincides with the pumping stroke of said second pump and the pumping stroke of said first pump coincides with the intake stroke of said second pump, a pressure relief valve fluidly connected between said crossover pipe and at least one of said inlets of said first and second pumps.

2. The fuel delivery system of claim 1 wherein said first and second pumps are each piston pumps.

3. The fuel delivery system of claim 2 wherein each of said pumps is a cam driven pump.

4. The fuel delivery system of claim 1 wherein said first and second pumps are substantially identical with each other.

5. The fuel delivery system of claim 1 wherein said relief valve is fluidly connected to said crossover pipe midway between said first and second fuel rails.

* * * * *